US005703633A

United States Patent [19]

Gehrer et al.

[11] Patent Number: 5,703,633

[45] Date of Patent: Dec. 30, 1997

[54] INK CONTAINER WITH A CAPILLARY ACTION MEMBER

[75] Inventors: Udo Gehrer; Rolf Gibbels, both of Wuerselen; Heinz-Josef Frenken, Stolberg, all of Germany

[73] Assignee: Dia Nielsen GmbH Zubehoer fuer Messtechnik, Dueren, Germany

[21] Appl. No.: 292,888

[22] Filed: Aug. 19, 1994

[30] Foreign Application Priority Data

Aug. 20, 1993 [DE] Germany ..... 43 28 001.3

[51] Int. Cl.[6] ..... B41J 2/175

[52] U.S. Cl. ..... 347/86

[58] Field of Search ..... 347/86, 87

[56] References Cited

U.S. PATENT DOCUMENTS

| | | | |
|---|---|---|---|
| 3,967,286 | 6/1976 | Anderson et al. | 347/87 |
| 5,010,354 | 4/1991 | Cowger et al. . | |
| 5,182,581 | 1/1993 | Kashimura et al. | 347/87 |
| 5,373,936 | 12/1994 | Kawai et al. | 347/86 X |
| 5,453,771 | 9/1995 | Waseda et al. | 347/87 |

*Primary Examiner*—John E. Barlow, Jr.
*Attorney, Agent, or Firm*—W. G. Fasse; W. F. Fasse

[57] ABSTRACT

A simple and economical construction and a reliable function is obtained for an ink container or ink pot with an ink reservoir by a closure coupling member that closes the ink withdrawal opening of the pot. The closure and coupling member has a capillary action for transporting ink. The pot includes an ink chamber with a capillary body so positioned inside the ink chamber that the open front face or first end of the capillary body is in direct contact with the ink while a back side of the capillary body communicates through a vent with the atmosphere. The chamber encloses the capillary body so that air can enter into the ink reservoir only through the capillary body to properly control the ink transport. For this purpose the capillary body functions as a pressure equalizer. The coupling member has a larger capillary action than the capillary body to make sure that ink is properly fed through the capillary coupling member to an ink consuming device.

12 Claims, 8 Drawing Sheets

INK CONTAINER WITH A CAPILLARY ACTION MEMBER

FIELD OF THE INVENTION

The invention relates to an ink container forming an ink reservoir for an ink supply. The container has an ink withdrawal opening and a separate chamber with a capillary body that functions as a pressure equalization vessel. Such ink containers, herein also referred to as ink pots, are used for example in an ink jet printer, a writing tip or the like.

BACKGROUND INFORMATION

Ink pots of the present type are basically divided into two groups each using a different system. One system uses ink storage devices which hold the entire ink quantity in a sponge-type member. Another system comprises a reservoir which holds free ink. Free ink in this context means a liquid body of ink held in a reservoir and not in a sponge-type body or in any other capillary action body. The present disclosure relates to an ink pot with a reservoir for holding free ink.

U.S. Pat. No. 5,010,354 (Cowger) discloses an ink jet pen with an improved volumetric efficiency, having an ink container in which a pack of lamellae is used as a capillary lamellae body. It is rather difficult to produce lamellae bodies that function satisfactorily. The lamellae body is supposed to function as a pressure equalization vessel which must be in contact with the ink in the ink reservoir through a separation wall that has the required or respective capillarity. Depending on the instantaneous pressure conditions, the lamellae body must be capable of either withdrawing ink from the reservoir or return ink into the reservoir. Due to the fact that the lamellae body is separated from the free ink in the ink reservoir by the separation wall, cumbersome steps must be taken for feeding just the sufficient amount of air into the ink reservoir of the ink container. To meet these requirements the ink container must be equipped with a printing head as a closure element. Without such a closure element the ink container is not usable. Additionally, the entire structure is involved, whereby the above mentioned manufacturing problems are encountered. As a result, the known ink pot is not quite economical. Further, it is necessary to assure a proper capillary tuning of the capillary separation wall between the ink and the capillary body. Said tuning relating to the capillary body relative to the bubble generator.

It is mentioned in the last paragraph of column 5 of U.S. Pat. No. 5,010,354 (Cowger) that the separation element or capillary volume element (20) need not be made of lamellae. Instead, other equivalent structures such as folded ribbons, or honeycombs, or interdigitated fins, or spiral forms, or cylinders, or glass beads, or uniform cellular foam may be used. Nevertheless, the above described problems have not been satisfactorily solved in the prior art. Therefore, there is room for improvement.

OBJECTS OF THE INVENTION

In view of the above it is the aim of the invention to achieve the following objects singly or in combination:

to improve an ink pot that has a reservoir to hold free ink above in such a way that the function of its capillary body as a pressure equalization vessel is under control with certainty, and so that the capillary tuning mentioned above, between the capillary body and the separation wall that contacts the free ink in the reservoir and that cooperates with the capillary body, can be obviated;

to make sure that the capillary body and the capillary separation wall can be constructed and arranged completely independently of each other;

to make the capillary body and a capillary coupling member of readily available inexpensive capillary wicking materials such as open cell foam materials, felts, fibers, especially linear fiber materials;

to assure a uniform filling of the capillary body, thereby facilitating its function as a pressure equalizing member;

to provide an optimal space utilization while simultaneously assuring that the facing end or front end of the capillary body is directly in contact with the free ink in the reservoir;

to provide the present ink pot with a pump for temporarily increasing the pressure in the reservoir without adversely affecting the air in the capillary body; and to connect the ink facing end of the capillary body and/or the ink facing surface of the capillary coupling through an ink conducting element such as a wick to the bottom of the ink reservoir so as to avoid a dry out of the ink facing surfaces.

SUMMARY OF THE INVENTION

The above objects have been achieved according to the invention in an ink container or pot forming a reservoir in which the ink withdrawal opening or port of the pot is closed by a capillary coupling member and wherein a capillary body is contained in a separate chamber inside the container or pot. The capillary body has a first capillarity and the capillary coupling has a second capillarity which is larger than the first capillarity of the capillary body, thereby preventing an entry of air into the ink reservoir through the capillary coupling member. The chamber holding the capillary body that functions as a pressure equalization member vessel and additionally makes sure that ink cannot leak out through the vent, is so arranged inside the ink container that an ink facing first surface or front end of the capillary body is directly open to the free ink in the reservoir while the vented or rear end second surface of the capillary body communicates through a vent with the atmosphere. Further, the chamber in which the capillary body is held encloses the capillary body around its circumference in a tight manner so that air cannot enter into the ink reservoir except through the capillary ducts of the capillary body, whereby, as mentioned, the capillary coupling member has a larger capillarity for the ink than the capillary body so that air cannot enter into the ink through the capillary coupling member.

According to the invention the capillary coupling member is a simple disk or plate, for example, made of sintered synthetic material. There is no need for any contact whatsoever nor any connection between the capillary coupling member and the capillary body. The capillary body itself is arranged in the above mentioned chamber which has an open port communicating directly with the ink in the reservoir so that the front end or ink facing surface of the capillary body is also in direct contact with the ink. Accordingly, the capillary coupling member and the capillary body can be constructed, arranged, and configured completely independently of each other.

The capillary body applies a continuous suction force to the ink so that when the operating temperature is rising, ink can be sucked into the capillary body. However, as soon as the reduced pressure caused by ink withdrawal through the capillary coupling member becomes larger than the reduced pressure generated by the capillarity of the capillary body, the ink is again sucked out of the capillary body until air can enter through the capillary ducts of the capillary body for venting the reservoir. An ink pot constructed as described has a substantial shelf life and it may be positioned in any desired or convenient orientation without any special features against a rapid spilling of the ink. The present structure inherently prevents such spilling. Further, the ink pot according to the invention is simple in its structure and hence cost efficient in its manufacture. The capillary body may be advantageously made of any suitable wicking material such as foam materials, felts, or fibrous materials, especially linear or elongated fiber material to form a storage for ink. Such a capillary body can be simply cut from commercially available half finished materials as mentioned above. These materials are relatively inexpensive, yet their intended wicking function by capillary action is assured with certainty.

According to the invention the capillary body serving as a storage for ink has preferably a squeezed-in section to form a reduced diameter at least along part of its length, whereby the squeezed-in section begins at the front end or ink facing end of the capillary body. The capillary bodies according to the invention have capillary channels of differing cross-sectional areas so that these channels are filling in different ways However, if such a storage or capillary body is squeezed in at least partially as taught by the invention, the cross-sectional flow areas of the capillary channels are made more uniform relative to each other because the differences are reduced by the squeezing. As a result, a uniform filling is achieved. This equalization of the capillary flow areas is especially advantageous in connection with capillary bodies made of linear or elongated fibers. It has been found that this advantage is already achieved if a rather short length section of the capillary body is squeezed in. This short length section is measured from the front end or ink facing end of the capillary body. The squeezing-in can reduce the cross-sectional flow area in the squeezed section, as compared to the unsqueezed section, by 25 to 50%.

According to a further embodiment of the invention the chamber for the capillary body is arranged so as to share at least one outside wall of the ink container, whereby the chamber has an opening or port so positioned that the front end or first end of the capillary body can communicate through this opening with the ink in the reservoir.

By arranging the chamber so as to share at least one outside wall of the ink container, the reservoir volume can be optimally increased while still meeting outer dimensional requirements.

The arrangement of the chamber for the capillary so that at least one outside wall of the ink pot or container is provided in common for the ink container and the chamber has the further advantage that the shape or configuration of the outside chamber can be adapted to any available nooks in the device where the pot is used e.g. an ink jet printer. This efficient utilization of available space provides another possibility of increasing the ink reservoir volume. The only requirement that needs to be met is the exposure of the front or first end of the capillary body by direct contact with the ink. If this condition is met it is of no further consequence in what direction or shape the capillary body portion outside the ink container is arranged. For an efficient exposure of the front end or ink facing surface of the capillary body care should be taken that this contact area or exposure area reaches as far down as possible relative to the depth of the ink reservoir as is shown in the accompanying drawings.

In a preferred embodiment of the invention the chamber for the capillary body is provided with a cover and a vent hole passes directly through the cover. Basically, such a cover with a vent hole is not necessary for an insertion opening in the chamber if the chamber is positioned inside the ink container but so that the capillary body can be inserted into the chamber from the outside of the ink container because the venting is achieved by simply leaving the insertion opening uncovered. However, such a vented cover can be easily constructed for avoiding the entrance of contaminations or liquids into the chamber. Hence, the use of the vented cover is preferred. The vent can be rather small in its diameter or cross-sectional flow area.

In all embodiments according to the invention the chamber for the capillary body is arranged inside the ink container. A difference merely resides in which wall is provided in common for the ink container and the chamber for the capillary body. In all embodiments it is quite easy to expose the ink contact surface or the first front end of the capillary body to the ink in the reservoir. The chamber merely needs to have a respective opening or port in the proper position. The specific arrangement of the chamber within the ink reservoir is not critical as long as it is made sure that the chamber port and the ink facing surface of the capillary body are positioned as low as possible within the ink container. As long as this condition is satisfied the chamber may share at least one or even more walls of the ink container whereby the bottom of the chamber is positioned close to the bottom of the ink container. However, arranging the chamber centrally within the container is also possible. These arrangements of the chamber inside the ink container provide good possibilities of adapting the ink container in an optimal manner to the production requirements on the one hand and to the space requirements and mounting devices on the other hand having regard to the limited space available, for example, in an ink jet printer. It is preferred that the chamber shares at least one wall with the ink container, thereby reducing the volume of the chamber and correspondingly increasing the volume of the ink reservoir. The wall that is shared should be provided with the vent for the chamber which frequently reduces the length of the venting channel, thereby providing the shortest possible distance from the chamber to the atmosphere.

However, according to a modified embodiment of the invention a chamber wall inside the ink reservoir is provided with the vent which in turn is connected through a duct to a venting opening in an outer wall of the ink container. The duct may be a rigid tubular member or a flexible hose. In both instances an efficient venting of the chamber for the capillary body is achieved when the chamber is completely positioned inside the ink container.

In a preferred embodiment of the invention an outer wall section of the ink container, preferably where the venting opening is provided, is constructed as a flexible membrane to form a pump membrane. Frequently, it is necessary when such ink containers are in use, to fill with ink a capillary step, jump or space between the capillary coupling member and the printing head that uses the ink. Such a so-called capillary jump or step is the free space between the capillary coupling member and the ink take-up surface of the printing head. The operability of the printing head can only be assured if the just mentioned space is filled with ink after attaching the ink container in a position for cooperation with the printing head. This is accomplished by increasing the pressure in the ink container or rather in the ink reservoir to press ink through the capillary channels of the coupling member so that the ink will be pressed into the just mentioned free space to thereby establish operational contact between the ink in the container and the ink take-up position or location of the printing head and so that a continuous emptying of the ink reservoir through the capillary action of the coupling member can be achieved. The above mentioned pump membrane is quite suitable for temporarily increasing the pressure within the ink reservoir of a newly inserted ink container. The venting opening is preferably positioned directly in the flexible wall section forming the membrane. Thus, this venting opening is held closed by the operator's finger while activating the membrane, whereby air in the chamber for the capillary body cannot escape during a pumping stroke so that the capillary channels of the capillary body are not filled with ink as a result of a pumping stroke. Rather, merely the ink is pressed through the capillary coupling member into the reservoir.

In a further preferred embodiment of the invention at least one, preferably both capillary components, namely the capillary coupling member and the capillary body in the chamber are connected with their ink contacting surfaces to a common or a respective ink conducting member such as a wick so that ink even from remote volume portions of the ink reservoir is conducted to the inlet or intake surfaces of the coupling element and the capillary body. Thus, the inlet area of the capillary body and the entire coupling member will always remain wetted with ink and thereby operational. This continuous wetting is important because if these areas dry out, the operability may be impaired. As mentioned, the wicking ink conducting member may be provided for the coupling member and the capillary body in common or each of these components may have its own wicking member that reaches to the lowest spot in the reservoir.

Another preferred embodiment of the invention with the chamber inside the ink reservoir, includes a chamber wall constructed as a cover for the chamber and the vent is positioned in this cover. This feature makes it simple to provide the cover with the vent before installing the cover. The cover as well as the outer wall with the venting opening are preferably each provided with a nipple for the attachment of a relatively small diameter hose section or pipe section for interconnecting the vent in the cover with the venting opening in the container wall.

It should be mentioned here, that the present ink container is not limited in its use in connection with an ink jet printer. Rather, the coupling member itself may be constructed as a writing tip so that a special printing head is not needed.

BRIEF DESCRIPTION OF THE DRAWINGS

In order that the invention may be clearly understood, it will now be described, by way of example, with reference to the accompanying drawings, wherein:

FIG. 5 is a sectional view of an embodiment in which the chamber for the capillary body is mounted inside the ink container by brackets or the like;

Figure 1:
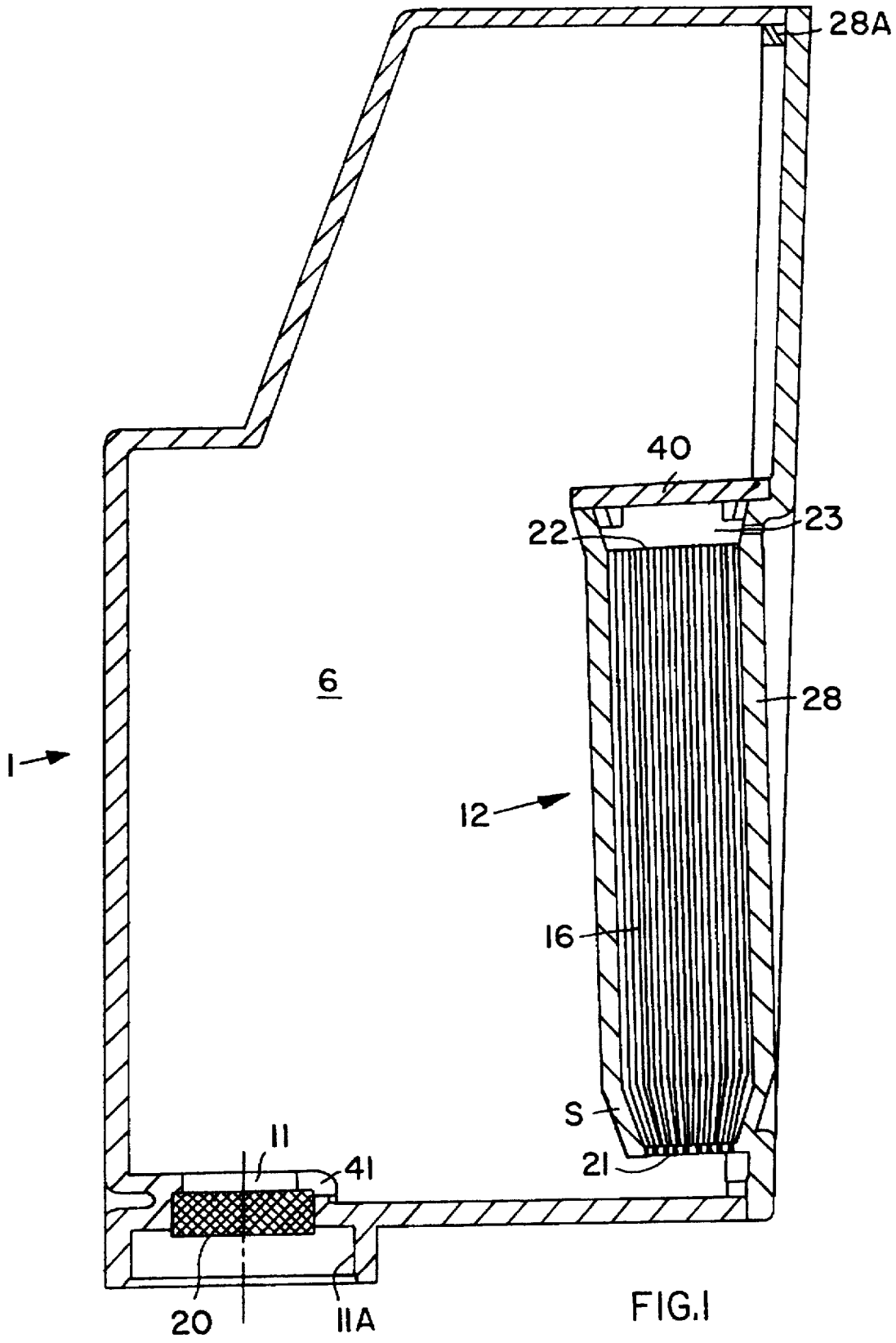
FIG. 1 is a sectional view through an ink pot or container according to the invention equipped with a capillary body in its own chamber inside the ink container and with a capillary coupling member separate from the capillary body.

DETAILED DESCRIPTION OF PREFERRED EXAMPLE EMBODIMENTS AND OF THE BEST MODE OF THE INVENTION

All eight figures illustrate the basic construction of the present ink pot or ink container. In all embodiments the ink container 1 or 2 or 3 or 4 or 5 encloses an ink reservoir 6 or 7 or 8 or 9 or 10. Each container comprises an ink withdrawal opening or port 11 which is closed by a capillary coupling member 20, 20A, 20E. These coupling members may have different configurations and they may be made of different wicking materials. In all instances the function is the same, namely to supply ink out of the reservoir into a printing head not shown but connected to the socket 11A shown for example in FIG. 1, or the coupling member may be constructed as a writing tip or for cooperation with a writing tip 42 as shown in FIG. 1A.

The ink containers 1, 2 and 5 are equipped with chambers 12 or 13 positioned inside the ink reservoirs with the respective capillary body 16 or 17 arranged inside the corresponding chamber. Chambers 12 or 13 have at least one wall 28 or 29 or 31 in common with a wall of the ink container 1, 2 or 5. The capillary body 16 has a front or first end 21 facing the ink in the reservoir 6 and a rear or second end 22 communicating with a vent 23.

The capillary bodies 16 or 17 in the chambers 12 or 13 are preferably made of fibrous materials forming a capillary storage for ink. The preferred fibers are linear or elongated fibers for this purpose. In the working position the capillary body 16 in containers 1 and 5 is arranged approximately vertically and the cross-sectional area of the capillary body is preferably rectangular so that the capillary body extends over the entire width of the ink container. However, in the ink container 2 the chamber 13 and its capillary body 17 are arranged horizontally at the bottom of the ink reservoir 7. The chamber 13 for the capillary body 17 has a wall 29 shared with the ink container 2. The wall 29 forms the bottom of the container 2.

Figure 1A:
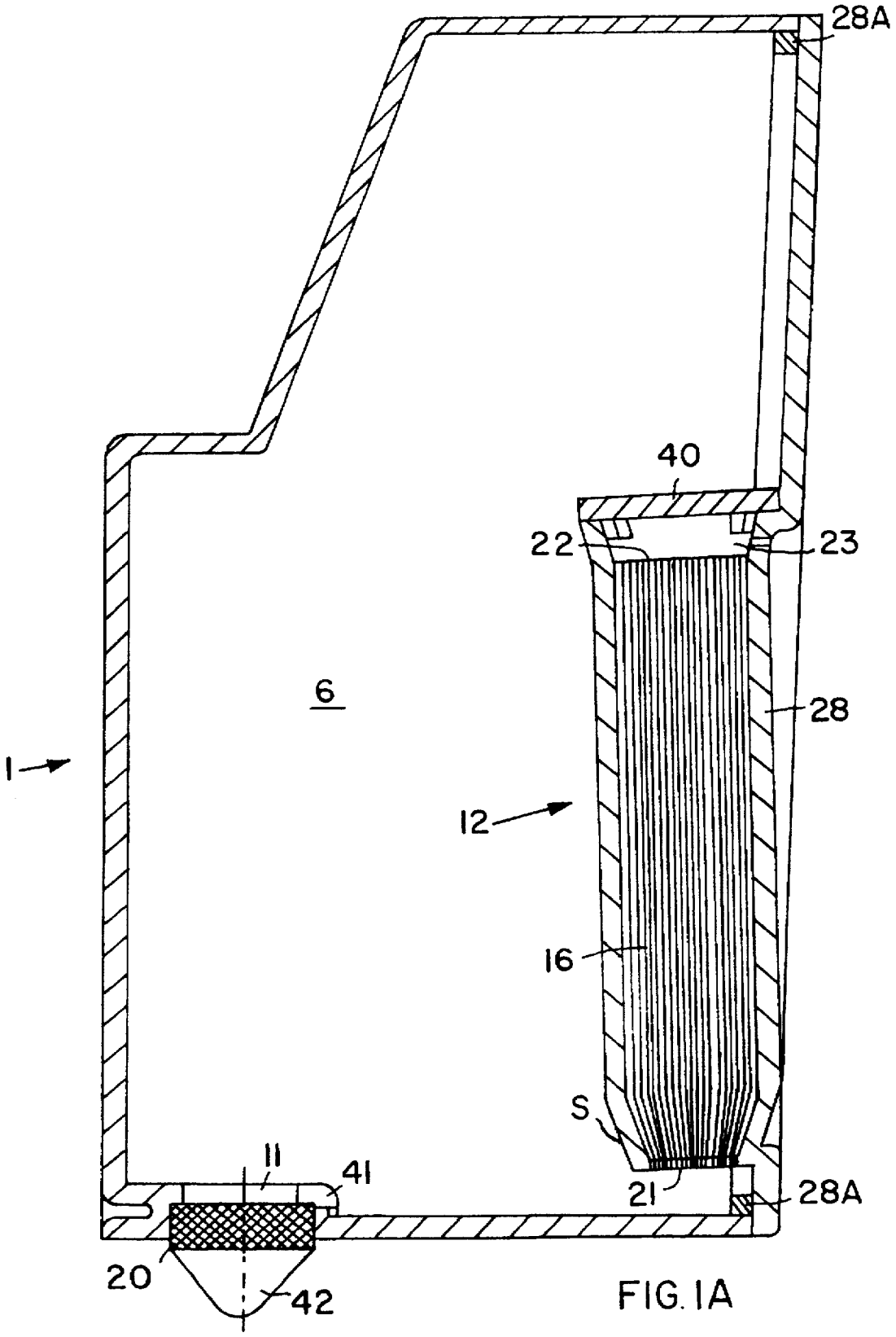
FIG. 1A is a view similar to that of FIG. 1, however, showing a capillary coupling member constructed as a writing tip.
Figure 2:
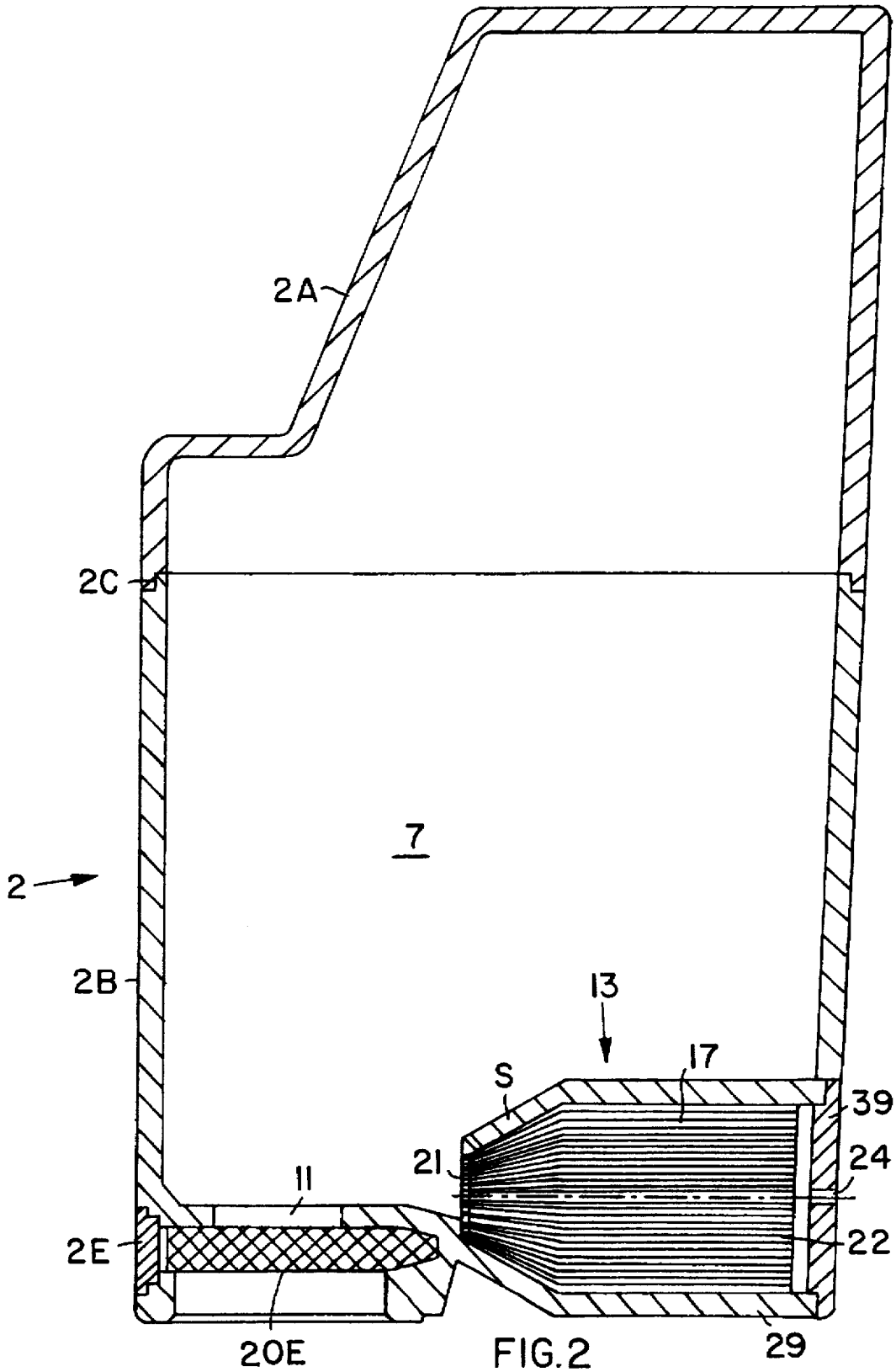
FIG. 2 is a view also similar to that of FIG. 1, but illustrating a modified location for the chamber inside the ink reservoir.

In FIGS. 1 and 1A the back wall 28 of the container is removable for filling the container, whereby the latter is maintained with its longitudinal axis horizontally for the filling. The back wall 28 can then be attached to the container in a sealed manner with the aid of a sealing rim 28A. In FIG. 2, the container 2 has a container top section 2A that is sealed to the container bottom section 2B along a rim 2C.

Each capillary body 16, 17, 18 and 19 has the abovementioned front end 21 or first surface 21 also referred to as ink facing end or surface 21 which is directly in a fluid exchange contact with the free ink in the reservoir and the second or rear surface 22. For this purpose the respective chambers 12, 13, 14 and 15 have an open end that communicates with the ink reservoir. Further, each of the chambers has a squeezed together section S of reduced cross-sectional flow area. The section S begins at the inlet end where the face 21 is positioned and continues in the direction of the longitudinal axis of the respective chamber for a relatively short distance as shown in the respective figures. As a result of the reduced cross-sectional flow area at the inlet end of the respective chambers, the capillary bodies 16, 17, 18 and 19 are also squeezed together correspondingly along a portion of the respective axial length. This feature equalizes cross-sectional differences in the capillary channels of the capillary bodies whereby the cross-sectional flow areas of these capillary channels are made more uniform at least along the squeezed section S. This feature of the invention assures a uniform filling and emptying cycle of the ink storage in the capillary channels of the respective capillary body while maximally utilizing the available space of the capillary bodies 16, 17, 18 and 19. The cross-sectional flow area in the reduced diameter section S near the front end 21 may be smaller by a factor within the range of 25% to 50% of the full diameter portion of the respective capillary body 16, 17, 18 and 19 outside section S.

The chamber 13 for the capillary body 17 in FIG. 2 is closed opposite the rear end or second surface 22 of the capillary body 17 by a removable cover 39 provided with a vent 24 for venting the chamber 13. Thus, the rear end 24 of the capillary body 17 is vented. A venting hole 23 in the back wall 28 of the embodiments shown in FIGS. 1 and 1A serves for the same purpose, namely to vent the rear end 22 of the respective capillary body 16. The chamber 12 is closed in a sealed manner by the cover 40 relative to the ink reservoir 6. The vent 23 enters into the respective chamber 12, 13 just above the rear end 22 of the respective capillary body. This arrangement makes sure that air can enter into the ink reservoir 6 or 7 only through the capillary ducts in the body 16 or 17 and out through the front face 21 but not through a gap between the capillary body and the inner surface of the chamber.

Figure 5:
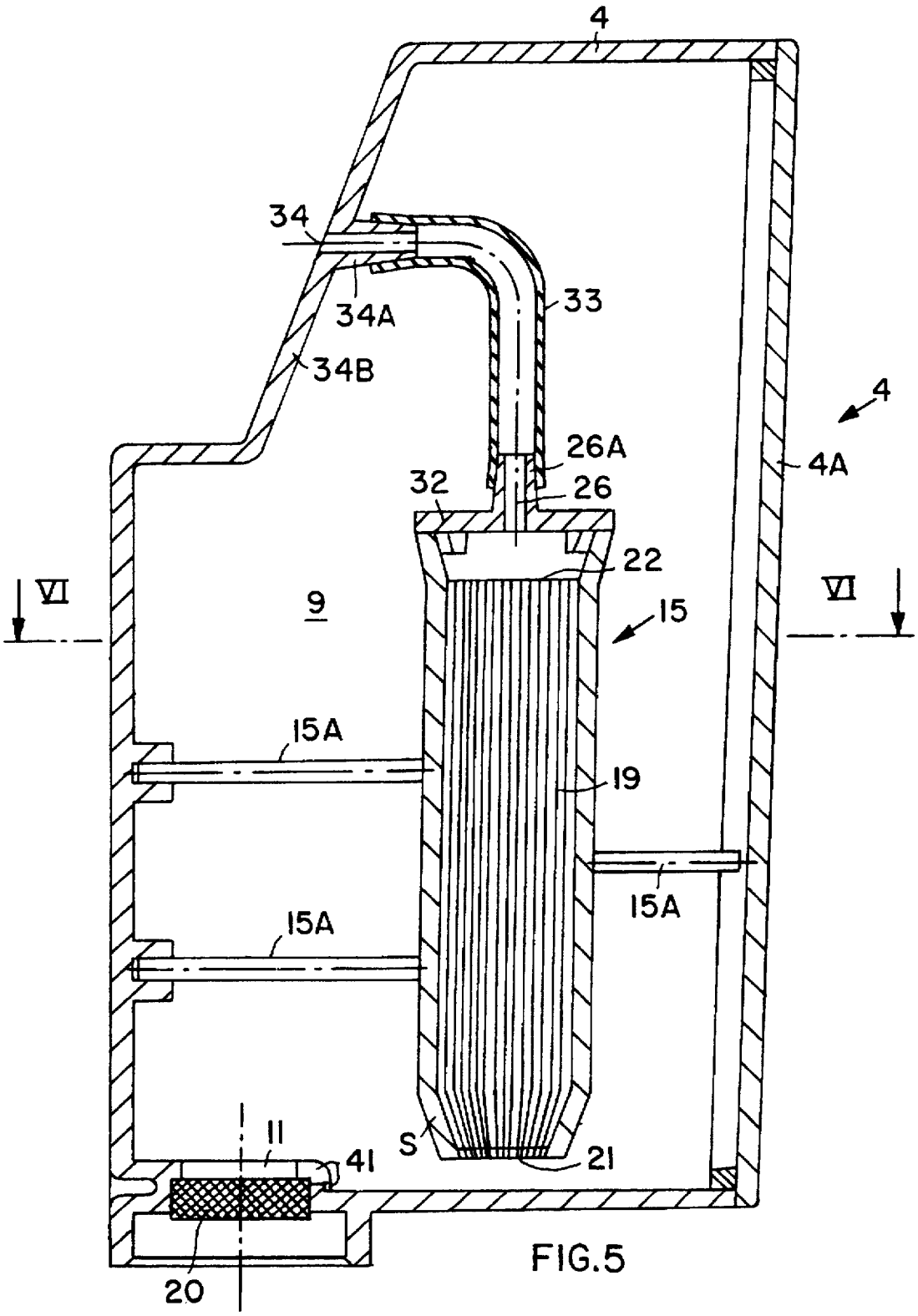
Figure 7:
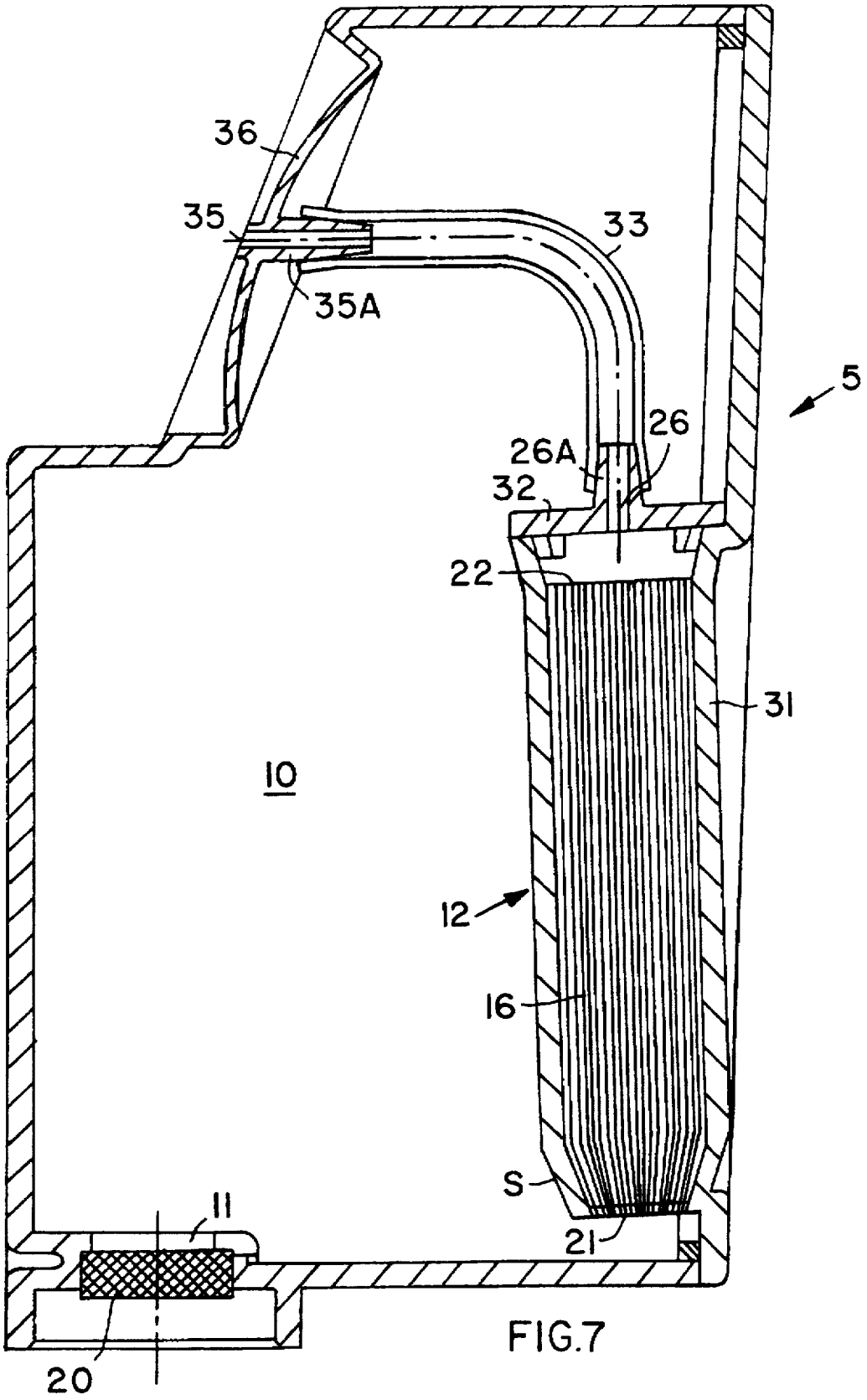
FIG. 7 shows a sectional view similar to that of FIG. 1, but illustrating a different venting system and showing a membrane pump for temporarily increasing the pressure in the ink reservoir.

In the embodiments shown in FIGS. 5 and 7, the interior tank 15 or 12 respectively is closed by a cover 32 provided with the vent 26 passing through a nipple 26A. The nipple 26A is connected through a venting duct such as a pipe or hose section 33 to an outside venting hole 34 in FIG. 5 and 35 in FIG. 7. Preferably, respective nipples 34A and 35A are used for securing the other end of the pipe or hose section 33.

In FIG. 7 an outer wall section 36 is constructed as a flexible pump membrane for temporarily pressurizing the ink reservoir 10 to pass ink through the capillary coupling member 20. Preferably, the nipple 35A with its venting hole 35 is secured to the flexible membrane wall section 36. In all of these instances the vent is so positioned that the rear end 22 of the respective capillary body is vented.

Figure 6:
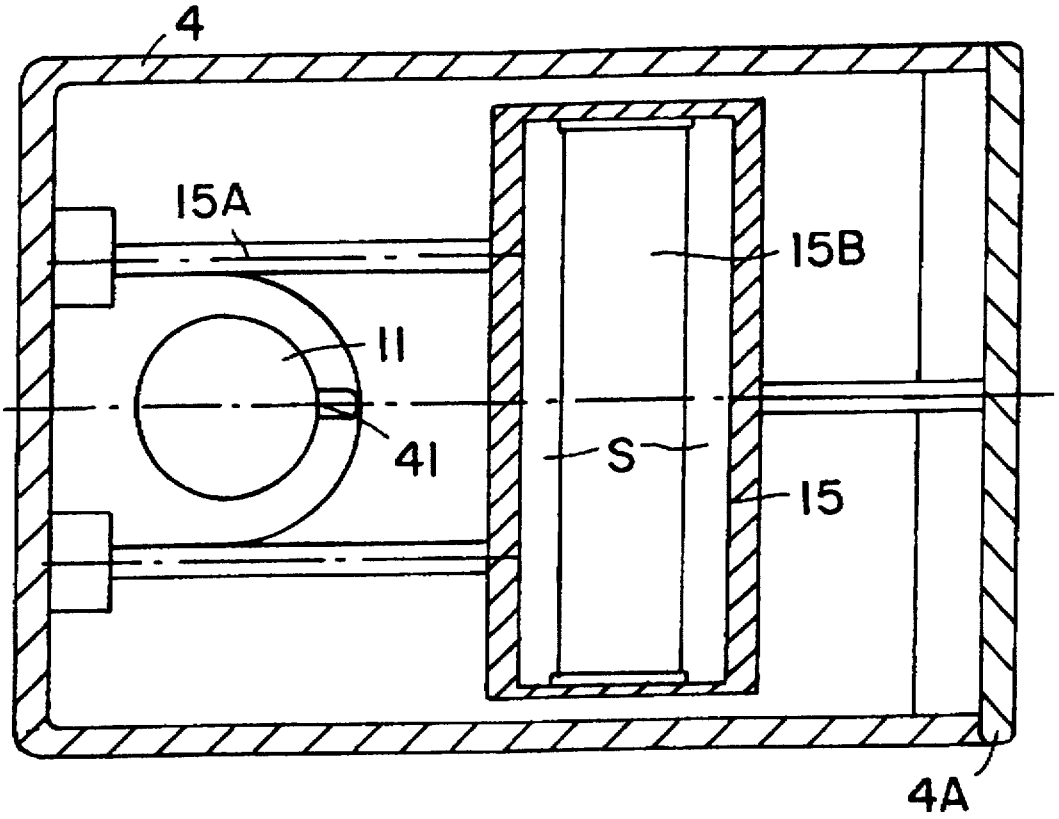
FIG. 6 is a sectional view along section line VI—VI in FIG. 5.

Referring further to FIGS. 5 and 6, in this embodiment the chamber 15 with its capillary body 19 does not have any common wall with the ink container 4 that is provided with a cover or closure 4A. Rather, the chamber 15 is secured inside the housing 4 by brackets 15A. Thus, the chamber 15 is freely suspended in the ink reservoir 9 inside the container or housing 4. Referring to FIG. 6, the squeezed-in section s of the chamber 15 extends along the entire width of the chamber 15 alongside the exit opening 15B of the chamber 15. As shown in FIG. 5 the rear side 22 of the capillary body 19 is vented through the vent 26, through the pipe or hose section 33 out through the venting hole 34. In the embodiment of FIG. 5 the outer wall section 34B holding the nipple 34A with the venting hole 34 is not flexible contrary to the flexible wall section 36 in FIG. 7.

Figure 3:
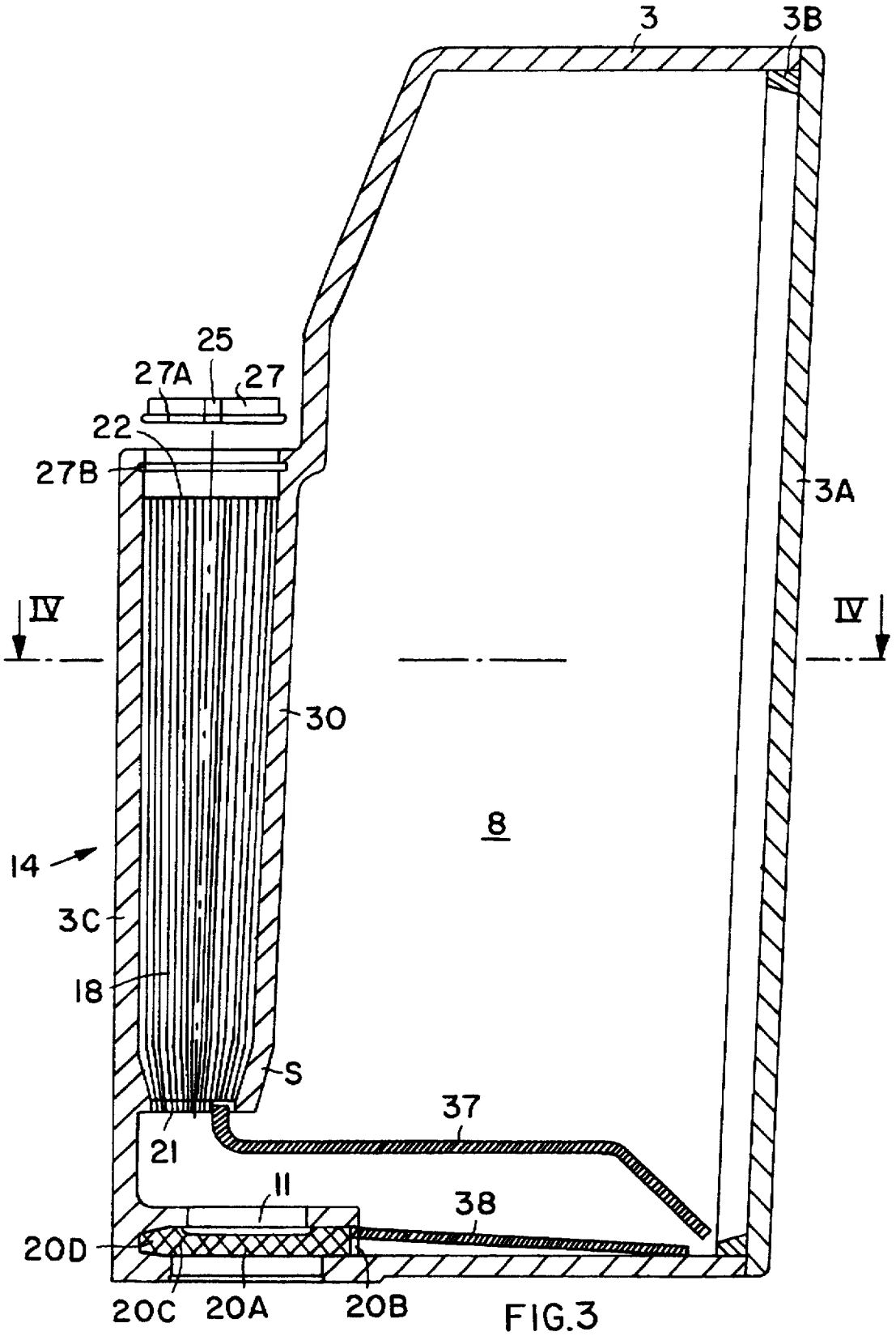
FIG. 3 is a sectional view of an embodiment in which the chamber for the capillary body is arranged inside the ink container but shares an outside wall the ink container.
Figure 4:
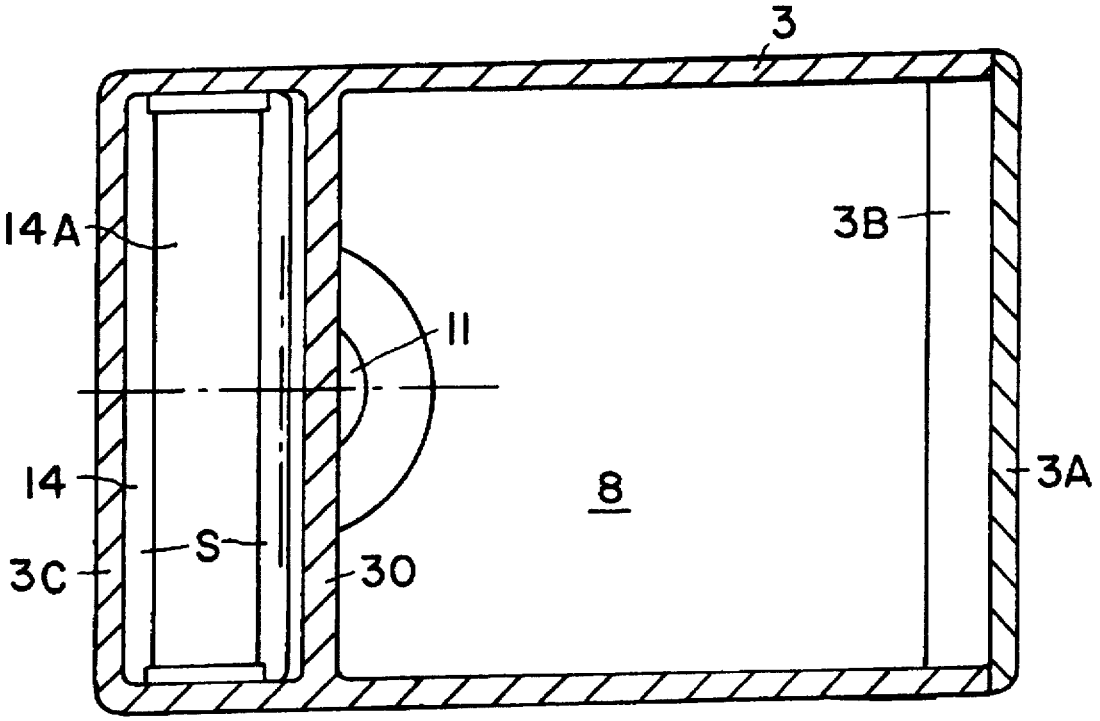
FIG. 4 is a sectional view along section line IV—IV in FIG. 3.

FIGS. 3 and 4 illustrate the arrangement of the chamber 14 with its capillary body 18 so as to share an outside wall 3A of the ink container 3 which is closed by a cover 3A provided with a seal rim 3B. Basically, the construction and dimensions of the chamber 14 can be substantially the same as those of the chamber 12. This applies equally to the capillary body 18 relative to the capillary body 16. A separation wall 30 is shared by the chamber 14 and the container 3 and thus forms part of the housing or container 3 and part of the chamber 14 which has a width corresponding to the width of the container housing 3 as best seen in FIG. 4 which shows that the walls 3, 3C enclose both the chamber 14 and the ink reservoir 8. The squeezed-in section 14A extends also over the entire width of the chamber 14 so that the reservoir facing opening 14A is flanked by the squeezed-in side walls forming the section S. As best seen in FIG. 3, the rear end 22 of the capillary body 18 is vented through a vent 25 in a cover 27 that has a sealing rim 27A fitting into a groove 27B of the chamber 14.

In FIGS. 1 and 2, the capillary coupling member 20 is simply inserted into its respective socket from below. A slight press-fit is sufficient to hold the coupling member 20 in place. The same holds true for the embodiments of FIGS. 5 and 7. However, in FIG. 3 the capillary coupling member 20A is inserted by sliding it through a gap 20B when the cover 3A is removed. Further, in FIG. 3 each of the capillary components, namely the capillary coupling member 20A and the capillary body 18 are provided with their respective ink conducting elements 38 and 37 such as a wick connected at one end to the coupling 20A or to the body 18 while the other end reaches to the lowest point in the reservoir 8 to keep the coupling member 20A and the front end or facing end 21 wetted with ink.

In order to facilitate the function of the wicking elements 37 and 38 to keep the coupling member 20A and the forward or facing end 21 constantly wetted, it is preferred to end these wicking elements in a lowest spot that may be formed as a sink in the container. Incidentally, these wicking elements 37, 38 may be provided in each of the embodiments. Further, the wicking elements are so arranged that they will transport or conduct ink in any position of the container. FIG. 5 shows another possibility of keeping the coupling member 20 wetted by ink passing through ink guide grooves 41 also shown in FIGS. 1 and 1A.

The ink containers or the housings forming these containers may deviate from the illustrated configurations which can be easily adapted to the requirements of any ink jet printer or the like. Common to all embodiments, however, is the capillary coupling member and the capillary body which are completely independent of each other in their structure and in their location. The capillary coupling member may have different configurations. For example, in FIG. 3 the coupling member 20A has a disk shape with a slight depression 20C in its center facing into the container and with a tapered edge 20D fitting into a respective groove in the housing wall. Another configuration for a capillary coupling member 20E is shown in FIG. 2 which has also a disk shape that is laterally inserted through a slot 2D in the housing section 2B that is covered by a plug 2E.

In all embodiments the coupling member and the capillary body are completely independent of each other and each performs its function independently of the other. The capillary body makes sure that the required pressure equalization inside the reservoir is provided in response to pressure and/or temperature variations during operation. The coupling member on the other hand makes sure that ink will always be fed either to a printing head, to a writing tip 42, or the like. The writing tip may be an independent member that is placed in contact with the respective capillary coupling member. The device in ink transferring contact with the coupling member or rather with the outwardly facing surface of the coupling member, should have a higher capillarity for ink for withdrawing ink through the coupling member so that the ink using element can work as such.

If a printing head is inserted into the socket 11A there is a small free space between the printing head surface facing the outer surface of the respective coupling member. That free space must be filled with ink. When the printing head sucks up the ink in this free space, a respective reduced pressure is produced so that the ink will tend to flow through the capillary coupling member into the free space to continuously supply the printing head.

The above mentioned free space between the coupling member and the printing head in its socket 11A needs to be filled with ink after an empty container has been replaced by a full container. This filling is accomplished by the pump membrane 36 shown in FIG. 7 as described above. When the operator pumps the membrane 36 he simultaneously closes the venting hole 35 so that the pressure in the reservoir 10 is increased to push ink through the capillary ducts of the coupling member 20 into the above mentioned free space. Since the venting holes 35 is closed by the operator's finger, the ink cannot enter into the capillary body 16 since venting is prevented at this time. Thus, the momentarily increased pressure in the reservoir 10 is sufficient to feed ink through the coupling member 20 as described, whereby the momentarily increased pressure makes sure that thereafter the ink keeps flowing through the coupling member to the ink using element.

Although the invention has been described with reference to specific example embodiments, it will be appreciated that it is intended to cover all modifications and equivalents within the scope of the appended claims.

What is claimed is:

1. An ink container for dispensing ink comprising an ink container forming a reservoir for containing ink in said reservoir, an ink withdrawal opening, a capillary coupling member for closing said withdrawal opening, a chamber including a vent to atmosphere and an open end, a capillary body in said chamber, said capillary body having a first capillarity, said capillary body further having a first end and a second end and at least one squeezed section beginning at said first end and extending lengthwise of said capillary body, said capillary coupling member for closing said ink withdrawal opening having a second capillarity larger than said first capillarity of said capillary body for preventing entry of air into said ink reservoir through said coupling member, said chamber having the capillary body being arranged inside said ink container so that said first end of said capillary body faces said open end of said chamber for direct contact with ink in said ink reservoir and so that said second end of said capillary body communicates through said vent with the atmosphere, said chamber enclosing said capillary body so that air can enter into said ink reservoir only through capillary ducts in said capillary body and contact between said capillary coupling member and said capillary body is avoided.

2. The ink container of claim 1, wherein said capillary body is constructed of a wicking material including foam materials, felts, and fibrous materials, especially and linear fibers.

3. The ink container of claim 2, further comprising brackets, and wherein said chamber is mounted inside said container by said brackets.

4. The ink container of claim 1, wherein said ink container comprises outside container walls, said chamber holding said capillary body being arranged inside said ink container to share at least one outside container wall of said outside container walls of said ink container to form a common wall that is part of said ink container and part of said chamber, said chamber comprising said open end inside said ink container so that said first end of said capillary body communicates with said reservoir through said open end in said chamber.

5. The ink container of claim 4, further comprising a rear end opening in said chamber, a cover for closing said rear end opening of said chamber, and wherein said cover comprises a hole forming said vent.

6. The ink container of claim 1, further comprising at least one ink conducting element connected to at least one of said capillary body and said coupling member, said ink conducting element reaching into said reservoir for feeding ink.

7. The ink container of claim 6, comprising two ink conducting elements, one ink conducting element being connected to said front end of said capillary body, the other ink conducting element being connected to said capillary coupling member.

8. The ink container of claim 7, wherein said ink conducting elements are wicks.

9. The ink container of claim 1, wherein said chamber comprises an inside wall section inside said ink container, said inside wall section having a hole forming said vent, said ink container further comprising an outside wall portion with a venting hole in said outside wall portion and a venting duct connecting said vent with said venting hole for venting said chamber.

10. The ink container of claim 9, wherein said inside wall section is a cover for said chamber inside said ink container, said vent extending through said cover.

11. The ink container of claim 9, wherein said outside wall portion having said venting hole therein is made of a flexible material to form a pump membrane for increasing the pressure in said ink reservoir, said venting duct also being made of flexible material to permit movement of said membrane.

12. The ink container of claim 1, wherein said chamber and said ink container comprise at least one wall in common, and wherein said common wall comprises at least one hole forming said vent.

* * * * *

UNITED STATES PATENT AND TRADEMARK OFFICE

CERTIFICATE OF CORRECTION

PATENT NO. : 5,703,633
DATED : December 30, 1997
INVENTOR(S) : Udo Gehrer, et al.

It is certified that error appears in the above-identified patent and that said Letters Patent is hereby corrected as shown below:

On the Title Page, in [56] References Cited,
line 1, replace "Anderson et al." by --Andersson et al.--.

Col. 5 , line 62, after "wall" insert --of--.

Col. 6, line 54, replace "abovemen-" by --above men- --.

Col. 10, line 3, delete "especially";
line 28, replace "front" by --first--.

Signed and Sealed this

Twenty-fourth Day of March, 1998

Bruce Lehman

*Attest:*

BRUCE LEHMAN

*Attesting Officer*

*Commissioner of Patents and Trademarks*